US008760044B2

(12) United States Patent
Ma

(10) Patent No.: US 8,760,044 B2
(45) Date of Patent: Jun. 24, 2014

(54) ELECTRODE MATERIAL FOR A SPARK PLUG

(75) Inventor: Shuwei Ma, Ann Arbor, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 52 days.

(21) Appl. No.: 13/402,437

(22) Filed: Feb. 22, 2012

(65) Prior Publication Data

US 2012/0212119 A1 Aug. 23, 2012

Related U.S. Application Data

(60) Provisional application No. 61/445,086, filed on Feb. 22, 2011.

(51) Int. Cl.
*H01T 13/20* (2006.01)

(52) U.S. Cl.
USPC ..... 313/141; 313/144

(58) Field of Classification Search
USPC ..... 313/118–145; 445/7, 46, 49
See application file for complete search history.

(56) References Cited

U.S. PATENT DOCUMENTS

| | | | |
|---|---|---|---|
| 2,328,580 | A | 9/1943 | Pickus |
| 2,391,456 | A | 12/1945 | Hensel |
| 2,391,457 | A | 12/1945 | Carlson |
| 2,406,172 | A | 8/1946 | Smithells |
| 2,470,034 | A | 5/1949 | Hensel |
| 2,545,438 | A | 3/1951 | Stumbpck |
| 3,159,460 | A | 12/1964 | Hill |
| 3,278,280 | A | 10/1966 | Holtz |
| 3,362,799 | A | 1/1968 | Fletcher |
| 3,528,862 | A | 9/1970 | Jones et al. |
| 3,868,430 | A | 2/1975 | Giangaspero |
| 3,957,451 | A | 5/1976 | Rasmussen et al. |
| 3,977,841 | A | 8/1976 | Rasmussen et al. |
| 4,324,588 | A | 4/1982 | Zysk et al. |
| 4,351,095 | A | 9/1982 | Davies |
| 4,427,915 | A | 1/1984 | Nishio |
| 4,659,960 | A | 4/1987 | Toya |
| 4,692,657 | A | 9/1987 | Grunwald et al. |
| 4,743,793 | A | 5/1988 | Toya et al. |
| 4,771,209 | A | 9/1988 | Ryan |
| 4,786,267 | A | 11/1988 | Toya et al. |
| 4,881,913 | A | 11/1989 | Mann |
| 4,910,428 | A | 3/1990 | Strumbos |

(Continued)

FOREIGN PATENT DOCUMENTS

| | | |
|---|---|---|
| DE | 10005559 | 8/2001 |
| GB | 556253 | 9/1943 |

(Continued)

OTHER PUBLICATIONS

English machine translation for JP2001-262253A.*

(Continued)

*Primary Examiner* — Anne Hines
(74) *Attorney, Agent, or Firm* — Reising Ethington P.C.

(57) ABSTRACT

An electrode material may be used in spark plugs and other ignition devices including industrial plugs, aviation igniters, glow plugs, or any other device that is used to ignite an air/fuel mixture in an engine. In one embodiment, the electrode material has one or both of iridium (Ir) or ruthenium (Ru), and has rhenium (Re).

17 Claims, 8 Drawing Sheets

(56) References Cited

U.S. PATENT DOCUMENTS

| | | | |
|---|---|---|---|
| 4,939,409 | A | 7/1990 | Freise et al. |
| 5,101,135 | A | 3/1992 | Oshima |
| 5,347,193 | A | 9/1994 | Oshima |
| 5,448,130 | A | 9/1995 | Matsutani et al. |
| 5,456,624 | A | 10/1995 | Moore |
| 5,461,275 | A | 10/1995 | Oshima |
| 5,514,929 | A | 5/1996 | Kawamura |
| 5,550,425 | A | 8/1996 | Yoder |
| 5,578,895 | A | 11/1996 | Oshima |
| 5,675,209 | A | 10/1997 | Hall, Jr. |
| 5,793,793 | A | 8/1998 | Matsutani et al. |
| 5,796,019 | A | 8/1998 | Lupton |
| 5,866,973 | A | 2/1999 | Kagawa et al. |
| 5,869,921 | A | 2/1999 | Matsutani et al. |
| 5,890,272 | A | 4/1999 | Liberman |
| 5,894,186 | A | 4/1999 | Matsutani et al. |
| 5,898,257 | A | 4/1999 | Sequerra et al. |
| 5,990,602 | A | 11/1999 | Katoh et al. |
| 5,997,695 | A | 12/1999 | Ilmarinen |
| 5,998,913 | A | 12/1999 | Matsutani |
| 6,045,424 | A | 4/2000 | Chang et al. |
| 6,046,532 | A | 4/2000 | Matsutani et al. |
| 6,071,163 | A | 6/2000 | Chang et al. |
| 6,094,000 | A | 7/2000 | Osamura et al. |
| 6,095,124 | A | 8/2000 | Matsubara et al. |
| 6,121,719 | A | 9/2000 | Matsutani et al. |
| 6,166,479 | A | 12/2000 | Matsutani et al. |
| 6,262,522 | B1 | 7/2001 | Osamura et al. |
| 6,304,022 | B1 | 10/2001 | Matsutani |
| 6,326,719 | B1 | 12/2001 | Boehler |
| 6,407,487 | B1 | 6/2002 | Sugimoto |
| 6,412,465 | B1 | 7/2002 | Lykowski |
| 6,523,515 | B2 | 2/2003 | Kanao |
| 6,533,628 | B1 | 3/2003 | Matsutani et al. |
| 6,579,738 | B2 | 6/2003 | Farrar |
| 6,611,083 | B2 | 8/2003 | LaBarge et al. |
| 6,628,051 | B1 | 9/2003 | Menken |
| 6,664,719 | B2 | 12/2003 | Matsutani et al. |
| 6,750,597 | B1 | 6/2004 | Sakura |
| 6,790,113 | B1 | 9/2004 | Fujita |
| 6,794,803 | B2 | 9/2004 | Hori et al. |
| 6,798,125 | B2 | 9/2004 | Sugiyama et al. |
| 6,864,622 | B2 | 3/2005 | Matsutani et al. |
| 6,869,328 | B2 | 3/2005 | Ulm et al. |
| 7,084,558 | B2 | 8/2006 | Teramura et al. |
| 7,131,191 | B2 | 11/2006 | Matsutani et al. |
| 7,132,782 | B2 | 11/2006 | Kato et al. |
| 7,150,252 | B2 | 12/2006 | Sugiyama et al. |
| 7,164,225 | B2 | 1/2007 | Yoshimoto et al. |
| 7,221,078 | B2 | 5/2007 | Watanabe |
| 7,279,827 | B2 | 10/2007 | Nunome et al. |
| 7,288,879 | B2 | 10/2007 | Matsutani et al. |
| 7,321,187 | B2 | 1/2008 | Teramura et al. |
| 7,336,024 | B2 | 2/2008 | Yoshimoto et al. |
| 7,382,084 | B2 | 6/2008 | Yoshimoto et al. |
| 7,385,339 | B2 | 6/2008 | Lineton et al. |
| 7,449,823 | B2 | 11/2008 | Menken et al. |
| 7,569,979 | B2 | 8/2009 | Lykowski et al. |
| 7,637,793 | B2 | 12/2009 | Lintunen et al. |
| 7,815,849 | B2 | 10/2010 | Koch et al. |
| 2002/0024160 | A1 | 2/2002 | Sugimoto |
| 2003/0178925 | A1 | 9/2003 | Kumagai |
| 2004/0140745 | A1 | 7/2004 | Hrastnik |
| 2005/0168121 | A1 | 8/2005 | Tinwell |
| 2005/0179353 | A1 | 8/2005 | Watanabe |
| 2006/0158082 | A1 | 7/2006 | Menken |
| 2007/0057613 | A1 | 3/2007 | Brady |
| 2007/0190364 | A1 | 8/2007 | Das |
| 2007/0236123 | A1 | 10/2007 | Lykowski |
| 2007/0236124 | A1 | 10/2007 | Lykowski |
| 2008/0074025 | A1 | 3/2008 | Hori |
| 2008/0206601 | A1 | 8/2008 | Mukai |
| 2008/0308057 | A1 | 12/2008 | Lykowski |
| 2010/0026159 | A1 | 2/2010 | Ohm et al. |
| 2010/0052497 | A1 | 3/2010 | Walker, Jr. |
| 2010/0109502 | A1 | 5/2010 | Nakayama et al. |
| 2010/0117506 | A1 | 5/2010 | Suzuki et al. |
| 2010/0253203 | A1 | 10/2010 | Suzuki et al. |
| 2010/0264801 | A1 | 10/2010 | Tanaka et al. |
| 2010/0264802 | A1 | 10/2010 | Tanaka et al. |
| 2011/0043093 | A1 | 2/2011 | Nunome |
| 2011/0127900 | A1 | 6/2011 | Ma |
| 2011/0198983 | A1 | 8/2011 | Manhardt |
| 2012/0025690 | A1 | 2/2012 | Kohl |
| 2012/0025692 | A1 | 2/2012 | Ma |

FOREIGN PATENT DOCUMENTS

| | | |
|---|---|---|
| GB | 575998 | 3/1946 |
| GB | 717496 | 10/1954 |
| GB | 755835 | 8/1956 |
| GB | 830628 | 3/1960 |
| JP | 2207476 | 8/1990 |
| JP | 7268574 | 10/1995 |
| JP | 8339880 | 12/1996 |
| JP | 10321342 | 12/1998 |
| JP | 2000331770 | 11/2000 |
| JP | 2001262253 | 9/2001 |
| JP | 2002346625 | 12/2002 |
| JP | 2003053419 | 2/2003 |
| JP | 2004031300 | 1/2004 |
| JP | 3902756 | 5/2004 |
| JP | 2004235040 | 8/2004 |
| JP | 2008053017 | 3/2008 |
| JP | 2008053018 | 3/2008 |
| KR | 20020050486 | 6/2002 |

OTHER PUBLICATIONS

Written Opinion & International Search Report for PCT/US12/026103, Sep. 26, 2012, 9 pages.

International Search Report for PCT/US2010/058501, Aug. 31, 2011, 3 pages.

Written Opinion & International Search Report for PCT/US11/45767, Mar. 20, 2012, 11 pages.

* cited by examiner

ELECTRODE MATERIAL FOR A SPARK PLUG

REFERENCE TO RELATED APPLICATIONS

This application claims the benefit of U.S. Provisional Ser. No. 61/445,086 filed on Feb. 22, 2011, the entire contents of which are incorporated herein.

TECHNICAL FIELD

This invention generally relates to spark plugs and other ignition devices for internal combustion engines and, in particular, to electrode materials for spark plugs.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that is responsible for the power stroke of the engine. The high temperatures, high electrical voltages, rapid repetition of combustion reactions, and the presence of corrosive materials in the combustion gases can create a harsh environment in which the spark plug must function. This harsh environment can contribute to erosion and corrosion of the electrodes that can negatively affect the performance of the spark plug over time, potentially leading to a misfire or some other undesirable condition.

To reduce erosion and corrosion of the spark plug electrodes, various types of precious metals and their alloys—such as those made from platinum and iridium—have been used. These materials, however, can be costly. Thus, spark plug manufacturers sometimes attempt to minimize the amount of precious metals used with an electrode by using such materials only at a firing tip or spark portion of the electrodes where a spark jumps across a spark gap.

SUMMARY

According to one embodiment, there is provided a spark plug that comprises: a metallic shell that has an axial bore; an insulator that is at least partially disposed within the axial bore of the metallic shell and that has an axial bore; a center electrode that is at least partially disposed within the axial bore of the insulator; and a ground electrode that is attached to the metallic shell. The center electrode, the ground electrode, or both includes an electrode material having ruthenium (Ru) and rhenium (Re). The ruthenium (Ru) is the single largest constituent of the electrode material on a weight percentage (wt %) basis.

According to another embodiment, there is provided a spark plug that comprises: a metallic shell that has an axial bore; an insulator that is at least partially disposed within the axial bore of the metallic shell and that has an axial bore; a center electrode that is at least partially disposed within the axial bore of the insulator; and a ground electrode that is attached to the metallic shell. The center electrode, the ground electrode, or both includes an electrode material having one or both of iridium (Ir) or ruthenium (Ru), and having rhenium (Re). The iridium (Ir) or ruthenium (Ru) is the single largest constituent of the electrode material on a weight percentage (wt %) basis, and the electrode material has numerous grains with at least some of the grains being separated by a rhenium-rich grain boundary region.

According to yet another embodiment, there is provided a method of preparing a spark plug electrode material. The method may comprise the steps of: (a) providing a pre-alloy powder that includes a pre-determined amount of iridium (Ir) or ruthenium (Ru), and that includes a pre-determined amount of rhenium (Re); (b) providing a base powder of the same iridium (Ir) or ruthenium (Ru) that is present in the pre-alloy powder; (c) blending the pre-alloy powder and base powder together to form a powder mixture; and (d) sintering the powder mixture to form the spark plug electrode material.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
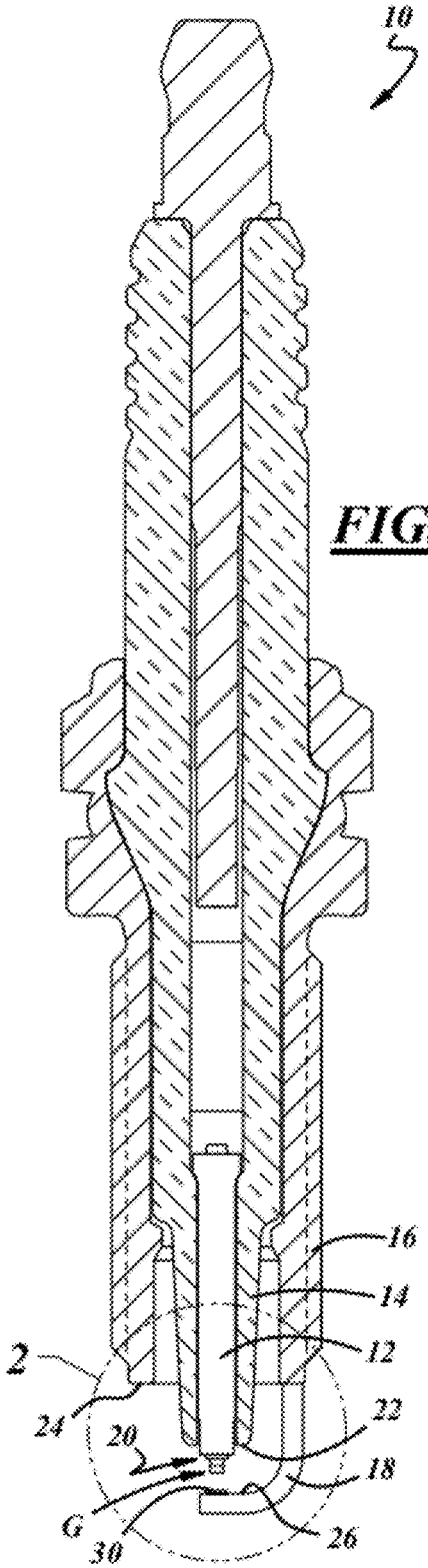
FIG. 1 is a cross-sectional view of an exemplary spark plug that may use the electrode material described below.

The electrode material described herein may be used in spark plugs and other ignition devices including industrial plugs, aviation igniters, glow plugs, or any other device that is used to ignite an air/fuel mixture in an engine. This includes, but is certainly not limited to, the exemplary spark plugs that are shown in the drawings and are described below. Furthermore, it should be appreciated that the electrode material may be used in a firing tip that is attached to a center and/or ground electrode or it may be used in the actual center and/or ground electrode itself, to cite several possibilities. Other embodiments and applications of the electrode material are also possible. All percentages provided herein are in terms of weight percentage (wt %).

Figure 2:
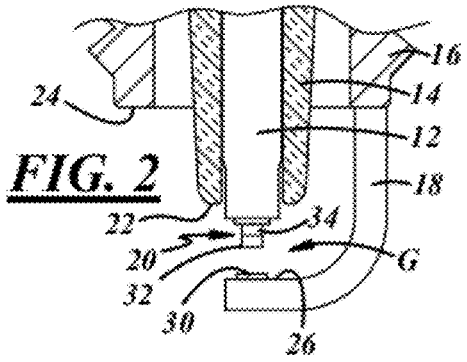
FIG. 2 is an enlarged view of the firing end of the exemplary spark plug from FIG. 1, wherein a center electrode has a firing tip in the form of a multi-piece rivet and a ground electrode has a firing tip in the form of a flat pad.

Referring to FIGS. 1 and 2, there is shown an exemplary spark plug 10 that includes a center electrode 12, an insulator 14, a metallic shell 16, and a ground electrode 18. The center electrode or base electrode member 12 is disposed within an axial bore of the insulator 14 and includes a firing tip 20 that protrudes beyond a free end 22 of the insulator 14. The firing tip 20 is a multi-piece rivet that includes a first component 32 made from an erosion- and/or corrosion-resistant material, like the electrode material described below, and a second component 34 made from an intermediary material like a high-chromium nickel alloy. In this particular embodiment, the first component 32 has a cylindrical shape and the second component 34 has a stepped shape that includes a diametrically-enlarged head section and a diametrically-reduced stem section. The first and second components may be attached to one another via a laser weld, a resistance weld, or some other suitable welded or non-welded joint. Insulator 14 is disposed within an axial bore of the metallic shell 16 and is constructed from a material, such as a ceramic material, that is sufficient to electrically insulate the center electrode 12 from the metallic shell 16. The free end 22 of the insulator 14 may protrude beyond a free end 24 of the metallic shell 16, as shown, or it may be retracted within the metallic shell 16. The ground electrode or base electrode member 18 may be constructed according to the conventional L-shape configuration shown in the drawings or according to some other arrangement, and is attached to the free end 24 of the metallic shell 16. According to this particular embodiment, the ground electrode 18 includes a side surface 26 that opposes the firing tip 20 of the center electrode and has a firing tip 30 attached thereto. The firing tip 30 is in the form of a flat pad and defines a spark gap G with the center electrode firing tip 20 such that they provide sparking surfaces for the emission and reception of electrons across the spark gap.

Figure 3:
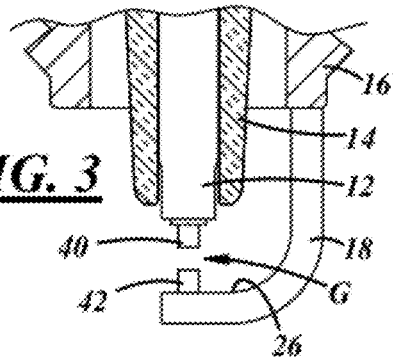
FIG. 3 is an enlarged view of a firing end of another exemplary spark plug that may use the electrode material described below, wherein the center electrode has a firing tip in the form of a single-piece rivet and the ground electrode has a firing tip in the form of a cylindrical tip.
Figure 4:
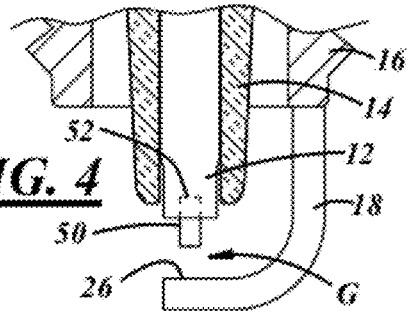
FIG. 4 is an enlarged view of a firing end of another exemplary spark plug that may use the electrode material described below, wherein the center electrode has a firing tip in the form of a cylindrical tip located in a recess and the ground electrode has no firing tip.
Figure 5:
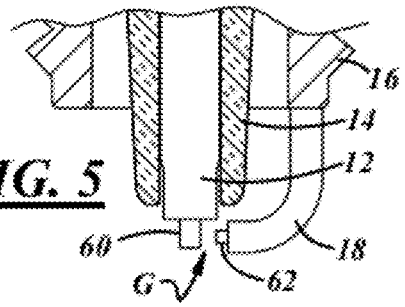
FIG. 5 is an enlarged view of a firing end of another exemplary spark plug that may use the electrode material described below, wherein the center electrode has a firing tip in the form of a cylindrical tip and the ground electrode has a firing tip in the form of a cylindrical tip that extends from an axial end of the ground electrode.

In this particular embodiment, the first component 32 of the center electrode firing tip 20 and/or the ground electrode firing tip 30 may be made from the electrode material described herein; however, these are not the only applications for the electrode material. For instance, as shown in FIG. 3, the exemplary center electrode firing tip 40 and/or the ground electrode firing tip 42 may also be made from the electrode material. In this case, the center electrode firing tip 40 is a single-piece rivet and the ground electrode firing tip 42 is a cylindrical tip that extends away from a side surface 26 of the ground electrode by a considerable distance. The electrode material may also be used to form the exemplary center electrode firing tip 50 and/or the ground electrode 18 that is shown in FIG. 4. In this example, the center electrode firing tip 50 is a cylindrical component that is located in a recess or blind hole 52, which is formed in the axial end of the center electrode 12. The spark gap G is formed between a sparking surface of the center electrode firing tip 50 and a side surface 26 of the ground electrode 18, which also acts as a sparking surface. FIG. 5 shows yet another possible application for the electrode material, where a cylindrical firing tip 60 is attached to an axial end of the center electrode 12 and a cylindrical firing tip 62 is attached to an axial end of the ground electrode 18. The ground electrode firing tip 62 forms a spark gap G with a side surface of the center electrode firing tip 60, and is thus a somewhat different firing end configuration than the other exemplary spark plugs shown in the drawings.

Again, it should be appreciated that the non-limiting spark plug embodiments described above are only examples of some of the potential uses for the electrode material, as it may be used or employed in any firing tip, electrode, spark surface or other firing end component that is used in the ignition of an air/fuel mixture in an engine. For instance, the following components may be formed from the electrode material: center and/or ground electrodes; center and/or ground electrode firing tips that are in the shape of rivets, cylinders, bars, columns, wires, balls, mounds, cones, flat pads, disks, rings, sleeves, etc.; center and/or ground electrode firing tips that are attached directly to an electrode or indirectly to an electrode via one or more intermediate, intervening or stress-releasing layers; center and/or ground electrode firing tips that are located within a recess of an electrode, embedded into a surface of an electrode, or are located on an outside of an electrode such as a sleeve or other annular component; or spark plugs having multiple ground electrodes, multiple spark gaps or semi-creeping type spark gaps. These are but a few examples of the possible applications of the electrode material, others exist as well. As used herein, the term "electrode"—whether pertaining to a center electrode, a ground electrode, a spark plug electrode, etc.—may include a base electrode member by itself, a firing tip by itself, or a combination of a base electrode member and one or more firing tips attached thereto, to cite several possibilities.

The electrode material is either an iridium-based material or a ruthenium-based material and includes rhenium (Re) from about 0.1-40 wt %. The electrode material is more ductile than some comparable iridium- and ruthenium-based materials, yet still maintains an acceptable level of erosion and corrosion resistance. The ductility of these electrode materials makes them more workable so that they can be more easily turned into a useful part. For example, for the multi-layer rivet (MLR) design discussed above and shown in FIGS. 1-2, a firing tip component 32 made from these more ductile electrode materials can be easily sheared off from a wire during manufacturing, and avoids the use of a diamond saw or similar apparatus. In some embodiments, the ductility improvement in the electrode material is at least partially attributable to the addition of rhenium (Re) and the particular manufacturing techniques involved, such as the powder metallurgy sintering and the post-sintering metal forming process such as, for example, the extrusion process taught below.

The term "iridium-based material," as used herein, broadly includes any material where iridium (Ir) is the single largest constituent on a weight percentage (%) basis. This may include materials having greater than 50% iridium, as well as those having less than 50% iridium so long as the iridium is the single largest constituent. According to an exemplary embodiment, the iridium-based material includes rhenium (Re) plus one or more precious metals. Some examples of suitable precious metals that may be used include rhodium (Rh), platinum (Pt), ruthenium (Ru), palladium (Pd), gold (Au) and combinations thereof. It is also possible for the iridium-based material to include one or more refractory metals, rare earth metals and/or other constituents.

The term "ruthenium-based material," as used herein, broadly includes any material where ruthenium (Ru) is the single largest constituent on a weight percentage (%) basis. This may include materials having greater than 50% ruthenium, as well as those having less than 50% ruthenium so long as the ruthenium is the single largest constituent. Skilled artisans will appreciate that ruthenium has a rather high melting temperature (2334° C.) compared to some precious metals, which can improve the erosion resistance of an electrode material including ruthenium. However, ruthenium can be more susceptible to oxidation than some precious metals, which can lower the corrosion resistance of the electrode material. Thus, the ruthenium-based material may include rhenium (Re) plus one or more precious metals. Some examples of suitable precious metals that may be used include rhodium (Rh), platinum (Pt), iridium (Ir), palladium (Pd), gold (Au) and combinations thereof. It is also possible for the ruthenium-based material to include one or more refractory metals, rare earth metals and/or other constituents.

As mentioned above, the electrode material described herein may include either an iridium-based material or a ruthenium-based material. The following embodiments are examples of different electrode materials that may be used, but they are not meant to be an exhaustive list of all such embodiments, as others are certainly possible. It should be appreciated that any number of other constituents may be added to the following embodiments, including one or more refractory metals like tungsten (W), rhenium (Re), tantalum (Ta), molybdenum (Mo) and/or niobium (Nb), one or more rare earth metals like yttrium (Y), hafnium (Hf), scandium (Sc), zirconium (Zr) or lanthanum (La), or other constituents such as nickel (Ni). A periodic table published by the International Union of Pure and Applied Chemistry (IUPAC) is provided in Addendum A (hereafter the "attached periodic table") and is to be used with the present application.

According to one embodiment, the electrode material includes either iridium (Ir) or ruthenium (Ru) from about 60 wt % to 99.9 wt % and rhenium (Re) from about 0.1 wt % to 40 wt %. Some non-limiting examples of potential compositions for such alloys include (in the following compositions, the Ir or Ru constitutes the balance): Ir-40Re, Ir-30Re, Ir-20Re, Ir-10Re, Ir-5Re, Ir-2Re, Ir-1Re, Ir-0.5Re, Ir-0.1Re, Ru-40Re, Ru-30Re, Ru-20Re, Ru-10Re, Ru-5Re, Ru-2Re, Ru-1Re, Ru-0.5Re and Ru-0.1Re. Some exemplary binary alloy compositions that may be particularly useful with spark plug electrodes include Ir-(0.1-5)Re and Ru-(0.1-5)Re.

According to another embodiment, the electrode material includes either iridium (Ir) or ruthenium (Ru) from about 50 wt % to 99.9 wt %, a single precious metal (other than the Ir or Ru just mentioned) from about 0.1 wt % to 49.9 wt %, and rhenium (Re) from about 0.1 wt % to 5 wt %. Some examples of suitable electrode materials having only one precious metal added to the iridium- or ruthenium-based material include: Ir—Rh—Re, Ir—Pt—Re, Ir—Ru—Re, Ir—Pd—Re, Ir—Au—Re, Ru—Rh—Re, Ru—Pt—Re, Ru—Ir—Re, Ru—Pd—Re and Ru—Au—Re alloys, where the iridium (Ir) or ruthenium (Ru) is still the largest single constituent. Some non-limiting examples of potential compositions for such alloys include (in the following compositions, the Re content is between about 0.1 wt % and 5 wt % and the Ir or Ru constitutes the balance): Ir-45Rh—Re, Ir-40Rh—Re, Ir-35Rh—Re, Ir-30Rh—Re, Ir-25Rh—Re, Ir-20Rh—Re, Ir-15Rh—Re, Ir-10Rh—Re, Ir-5Rh—Re, Ir-2Rh—Re, Ir-1Rh—Re, Ir-0.5Rh—Re, Ir-0.1Rh—Re, Ir-45Pt—Re, Ir-40Pt—Re, Ir-35Pt—Re, Ir-30Pt—Re, Ir-25Pt—Re, Ir-20Pt—Re, Ir-15Pt—Re, Ir-10Pt—Re, Ir-5Pt—Re, Ir-2Pt—Re, Ir-1Pt—Re, Ir-0.5Pt—Re, Ir-0.1Pt—Re, Ir-45Ru—Re, Ir-40Ru—Re, Ir-35Ru—Re, Ir-30Ru—Re, Ir-25Ru—Re, Ir-20Ru—Re, Ir-15Ru—Re, Ir-10Ru—Re, Ir-5Ru—Re, Ir-2Ru—Re, Ir-1Ru—Re, Ir-0.5Ru—Re, Ir-0.1Ru—Re, Ir-45Pd—Re, Ir-40Pd—Re, Ir-35Pd—Re, Ir-30Pd—Re, Ir-25Pd—Re, Ir-20Pd—Re, Ir-15Pd—Re, Ir-10Pd—Re, Ir-5Pd—Re, Ir-2Pd—Re, Ir-1Pd—Re, Ir-0.5Pd—Re, Ir-0.1Pd—Re, Ir-45Au—Re, Ir-40Au—Re, Ir-35Au—Re, Ir-30Au—Re, Ir-25Au—Re, Ir-20Au—Re, Ir-15Au—Re, Ir-10Au—Re, Ir-5Au—Re, Ir-2Au—Re, Ir-1Au—Re, Ir-0.5Au—Re, Ir-0.1Au—Re, Ru-45Rh—Re, Ru-40Rh—Re, Ru-35Rh—Re, Ru-30Rh—Re, Ru-25Rh—Re, Ru-20Rh—Re, Ru-15Rh—Re, Ru-10Rh—Re, Ru-5Rh—Re, Ru-2Rh—Re, Ru-1Rh—Re, Ru-0.5Rh—Re, Ru-0.1Rh—Re, Ru-45Pt—Re, Ru-40Pt—Re, Ru-35Pt—Re, Ru-30Pt—Re, Ru-25Pt—Re, Ru-20Pt—Re, Ru-15Pt—Re, Ru-10Pt—Re, Ru-5Pt—Re, Ru-2Pt—Re, Ru-1Pt—Re, Ru-0.5Pt—Re, Ru-0.1Pt—Re, Ru-45Ir—Re, Ru-40Ir—Re, Ru-35Ir—Re, Ru-30Ir—Re, Ru-25Ir—Re, Ru-20Ir—Re, Ru-15Ir—Re, Ru-10Ir—Re, Ru-5Ir—Re, Ru-2Ir—Re, Ru-1Ir—Re, Ru-0.5Ir—Re, Ru-0.1Ir—Re, Ru-45Pd—Re, Ru-40Pd—Re, Ru-35Pd—Re, Ru-30Pd—Re, Ru-25Pd—Re, Ru-20Pd—Re, Ru-15Pd—Re, Ru-10Pd—Re, Ru-5Pd—Re, Ru-2Pd—Re, Ru-1Pd—Re, Ru-0.5Pd—Re, Ru-0.1Pd—Re, Ru-45Au—Re, Ru-40Au—Re, Ru-35Au—Re, Ru-30Au—Re, Ru-25Au—Re, Ru-20Au—Re, Ru-15Au—Re, Ru-10Au—Re, Ru-5Au—Re, Ru-2Au—Re, Ru-1Au—Re, Ru-0.5Au—Re and Ru-0.1Au—Re. Some exemplary ternary alloy compositions that may be particularly useful with spark plug electrodes include Ir-(1-10)Rh-(0.1-2)Re and Ru-(1-10)Rh-(0.1-2)Re, and Ir-5Rh-1Re and Ir-2Rh-1Re.

According to another embodiment, the electrode material includes either iridium (Ir) or ruthenium (Ru) from about 35 wt % to 99.9 wt %, a first precious metal from about 0.1 wt % to 49.9 wt %, a second precious metal from about 0.1 wt % to 49.9 wt %, and rhenium (Re) from about 0.1 wt % to 5 wt %. Some examples of suitable electrode materials having two precious metals added to the iridium- or ruthenium-based material include: Ir—Rh—Pt—Re, Ir—Rh—Ru—Re, Ir—Rh—Pd—Re, Ir—Rh—Au—Re, Ir—Pt—Rh—Re, Ir—Pt—Ru—Re, Ir—Pt—Pd—Re, Ir—Pt—Au—Re, Ir—Ru—Rh—Re, Ir—Ru—Pt—Re, Ir—Ru—Pd—Re, Ir—Ru—Au—Re, Ir—Au—Rh—Re, Ir—Au—Pt—Re, Ir—Au—Ru—Re, Ir—Au—Pd—Re, Ru—Rh—Pt—Re, Ru—Rh—Ir—Re, Ru—Rh—Pd—Re, Ru—Rh—Au—Re, Ru—Pt—Rh—Re, Ru—Pt—Ir—Re, Ru—Pt—Pd—Re, Ru—Pt—Au—Re, Ru—Ir—Rh—Re, Ru—Ir—Pt—Re, Ru—Ir—Pd—Re, Ru—Ir—Au—Re, Ru—Au—Rh—Re, Ru—Au—Pt—Re, Ru—Au—Ir—Re and Ru—Au—Pd—Re alloys, where the iridium (Ir) or ruthenium (Ru) is still the largest single constituent in the respective alloys. Some non-limiting examples of potential compositions for such alloys include (in the following compositions, the Re content is between about 0.1 wt % and 5 wt % and the Ir or Ru constitutes the balance): Ir-30Rh-30Pt—Re, Ir-25Rh-25Pt—Re, Ir-20Rh-20Pt—Re, Ir-15Rh-15Pt—Re, Ir-10Rh-10Pt—Re, Ir-5Rh-5Pt—Re, Ir-5Rh-1Ru-1Re, Ir-2Rh-1Ru-1Re, Ir-2Rh-2Pt—Re, Ru-30Rh-30Pt—Re, Ru-25Rh-25Pt—Re, Ru-20Rh-20Pt—Re, Ru-15Rh-15Pt—Re, Ru-10Rh-10Pt—Re, Ru-5Rh-5Pt—Re, Ru-5Rh-1Ir-1Re, Ru-2Rh-1Ir-1Re, and Ru-2Rh-2Pt—Re. Some exemplary compositions that may be particularly useful with spark plug electrodes include Ir—Rh—Ru—Re and Ru—Rh—Re where the rhodium (Rh) content is from about 1 wt % to 10 wt %, the rhenium (Re) content is from about 0.1 wt % to 2 wt %, and the iridium (Ir)/ruthenium (Ru) constitutes the balance. Some exemplary quaternary alloy compositions that may be particularly useful with spark plug electrodes include Ir-(1-10)Rh-(0.1-5)Ru-(0.1-2)Re and Ru-(1-10)Rh-(0.1-5)Ir-(0.1-2)Re.

According to another embodiment, the electrode material includes either iridium (Ir) or ruthenium (Ru) from about 35 wt % to 99.9 wt %, a first precious metal from about 0.1 wt % to 49.9 wt %, a second precious metal from about 0.1 wt % to 49.9 wt %, a third precious metal from about 0.1 wt % to 49.9 wt %, and rhenium (Re) from about 0.1 wt % to 5 wt %. Some examples of suitable electrode materials having three precious metals added to the iridium- or ruthenium-based material include: Ir—Rh—Pt—Ru—Re, Ir—Rh—Pt—Pd—Re, Ir—Rh—Pt—Au—Re, Ru—Rh—Pt—Ir—Re, Ru—Rh—Pt—Pd—Re and Ru—Rh—Pt—Au—Re alloys, where the iridium (Ir) or ruthenium (Ru) is still the largest single constituent. An exemplary composition of the electrode material that has proven to be rather useful in spark plug electrodes is the ruthenium-based material Ru-(1-10)Rh-(0.5-5)Ir-(0.1-2)Re-(0.05-0.1)Y, Ru-(1-10)Rh-(0.5-5)Ir-(0.1-2)Re-(0.05-0.1)Hf, Ru-(1-10)Rh-(0.5-5)Ir-(0.1-2)Re-(0.05-0.1)Sc, Ru-(1-10)Rh-(0.5-5)Ir-(0.1-2)Re-(0.05-0.1)Zr, and Ru-(1-10)Rh-(0.5-5)Ir-(0.1-2)Re-(0.05-0.1)La.

Depending on the particular properties that are desired, the amount of iridium (Ir) or ruthenium (Ru) in the electrode material may be: greater than or equal to 35 wt %, 50 wt %, 65 wt % or 80 wt %; less than or equal to 99.9%, 95 wt %, 90 wt % or 85 wt %; or between 35-99.9%, 50-99.9 wt %, 65-99.9 wt % or 80-99.9 wt %, to cite a few examples. Likewise, the amount of any one precious metal in the electrode material may be: greater than or equal to 0.1 wt %, 2 wt %, 10 wt % or 20 wt %; less than or equal to 49.9 wt %, 40 wt %, 20 wt % or 10 wt %; or between 0.1-49.9 wt %, 0.1-40 wt %, 0.1-20 wt % or 0.1-10 wt %. The amount of precious metal combined or together in the electrode material may be: greater than or equal to 1 wt %, 5 wt %, 10 wt % or 20 wt %; less than or equal to 65 wt %, 50 wt %, 35 wt % or 20 wt %; or between 1-65 wt %, 1-50 wt %, 1-35 wt % or 1-20 wt %. The preceding amounts, percentages, limits, ranges, etc. are only provided as examples of some of the different material compositions that are possible, and are not meant to limit the scope of the electrode material.

Figure 6:
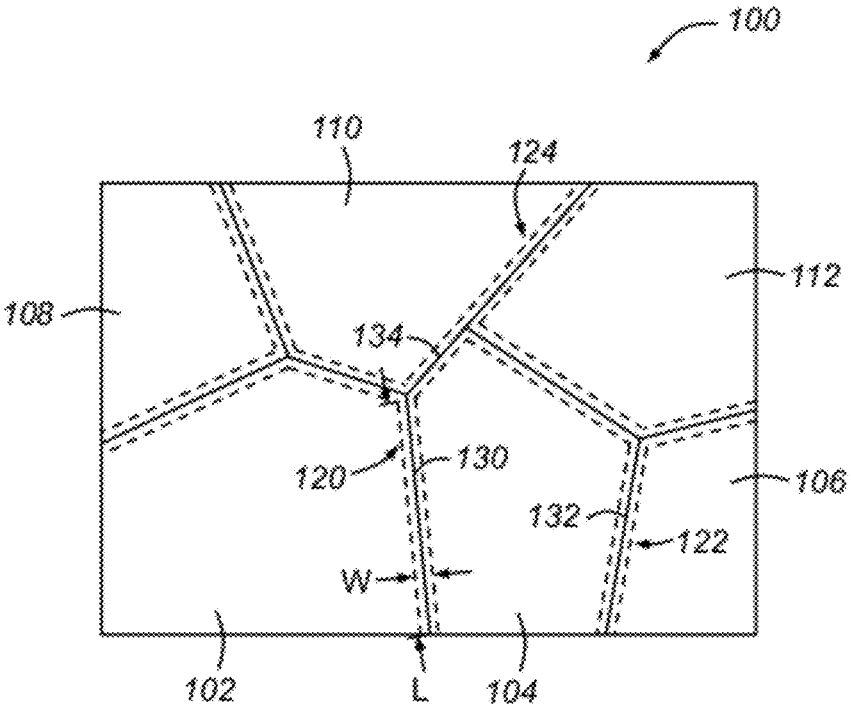
FIG. 6 is an illustration of a microstructure of the exemplary electrode material, where the electrode material has a number of individual grains.

With reference now to FIG. 6, there is shown an exemplary illustration of an enlarged section of the electrode material 100 which has a number of individual grains 102-112. As previously mentioned, the addition of rhenium (Re) may provide the electrode material with certain desirable attributes, such as increased ductility, increased workability and increased melting temperature. More specifically, it is possible for the rhenium (Re) to increase the solubility or dissolvability of some interstitial components—interstitials like nitrogen (N), carbon (C), oxygen (O), sulfur (S), phosphorous (P), etc. can conjugate or gather near low energy positions on grain boundaries 130-134 and thereby weaken the grain boundary rupture strength of the electrode material—so that the interstitials on grain boundaries 130-134 are dissolved in the matrix or body of the ruthenium (Ru) phase or iridium (Ir) phase on the nearby grain boundary regions 120-124. This mechanism reduces the impurities at grain boundaries 130-134. Each of the exemplary grain boundary regions 120-124 includes the area or space that surrounds or is near a corresponding grain boundary 130-134, respectively, and each of the exemplary grain boundaries is part of the interface or boundary between two contiguous grains. The exact dimensions or shape of the grains, grain boundaries and/or grain boundary regions may vary. But in an exemplary case, grain boundary region 120 is located between grains 102 and 104 and has an average grain boundary region length (L) from about 1 μm to 50 μm, and has an average grain boundary region width (W) from about 0.01 μm to 5 μm. These dimensions may be applicable to the electrode material before or after extrusion.

The addition of about 0.1 wt % to 5 wt % of rhenium (Re) to the electrode material may result in the grain boundary regions 120-124, and particularly the grain boundaries 130-134, being "rhenium-rich" and "interstitial-poor" during certain stages of the electrode material. To illustrate, rhenium-rich grain boundary regions 120-124 may have a higher concentration of rhenium (Re) than is found inside the electrode material lattice or matrix; this may be particularly true during pre-sintering stages of the material. For example, during pre-sintering stages, the rhenium (Re) concentration at the grain boundary region may be 50% higher or more than it is inside of the lattice or matrix of the electrode material. Sintering causes some of the rhenium (Re) to disperse or diffuse into the electrode material lattice or matrix such that, during post-sintering stages, a composition gradient is established where the rhenium (Re) content is still highest at the grain boundary regions and decreases further inside of the lattice or matrix. The characteristics of the composition gradient can be influenced by the sintering temperature and time. The high concentration of rhenium (Re) near grain boundary regions 120-124 may increase the solubility of certain impurities and thereby cause those impurities to dissolve in the ruthenium (Ru) or iridium (Ir) matrix in the nearby grain boundary regions 120-124; this may occur during both pre- and post-sintering stages of the electrode material. Otherwise, the interstitials or impurities may become segregated or concentrated on the grain boundaries 130-134.

Those skilled in the art will appreciate that the addition of about 0.1 wt % to 5 wt % of rhenium (Re) to the electrode material, may also promote excessive twinning in the electrode material, which in turn can act as a supplemental deformation mechanism to slipping for stress relaxation, particularly at low deformation temperatures. The rhenium (Re) may also increase the melting temperature of the electrode material, which can improve the material's erosion resistance. In exemplary embodiments, an iridium-based version of the electrode material has a melting temperature that is about 2400° C. and a ruthenium-based version of the electrode material has a melting temperature that is about 2300° C.

Figure 7:
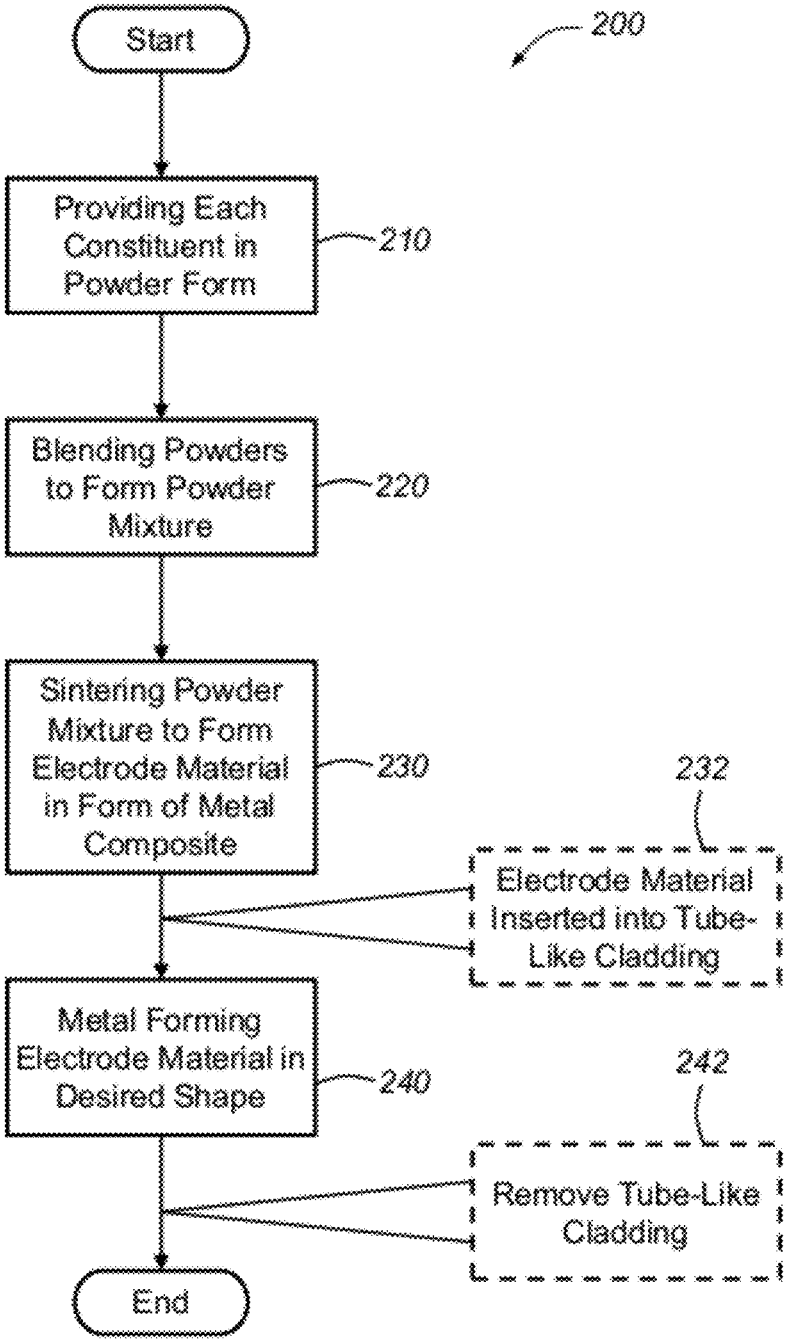
FIG. 7 is a flowchart illustrating an exemplary embodiment of a method for forming a spark plug electrode made from the electrode material illustrated in FIG. 6.

Turning now to FIG. 7, the electrode material can be made using a variety of manufacturing processes, including a powder metallurgy method. For instance, a process 200 may be used that includes the steps of: providing each of the constituents in powder form where they each have a certain powder or particle size, step 210; blending the powders together to form a powder mixture, step 220; sintering the powder mixture to form the electrode material, step 230; and extruding, drawing or otherwise forming the electrode material into a desired shape, step 240. The process may further include one or more optional steps that provide a cladding or sheath around the electrode material. The following discussion is provided in the context of an exemplary process for making an electrode material that is ruthenium-based; however, the same process could be used to make an electrode material that is iridium-based, only the iridium (Ir) would be substituted for ruthenium (Ru).

In step 210, the different constituents of the electrode material may be provided in powder form. According to one exemplary embodiment, ruthenium (Ru), one or more precious metals (e.g., rhodium (Rh), platinum (Pt), etc.), and rhenium (Re) are individually provided in a powder form where each of the constituents has a particle size that is about 0.1μ to 200μ, inclusive. In another embodiment, the ruthenium (Ru) and the one or more precious metals are pre-alloyed and formed into a base alloy powder first, before being mixed with the rhenium (Re). The first embodiment above (individual powders) may be most applicable to more simple systems (e.g., binary alloys having just Ir/Ru and Re), while the second embodiment (pre-alloying) may be better suited for more complex systems (e.g., ternary, quaternary and other more complicated alloys) such as Ru—Rh—Ir and Ru—Rh—Pt systems.

Next, step 220 blends the powders together so that a powder mixture is formed. In one embodiment, the powder mixture includes from about 35 wt % to 99.9 wt % of ruthenium (Ru), from about 0.1 wt % to 49.9 wt % of rhodium (Rh), from about 0.1 wt % to 49.9 wt % of platinum (Pt), and from about 0.1 wt % to 5 wt % of rhenium (Re). This mixing step may be performed with or without the addition of heat.

Figure 8:
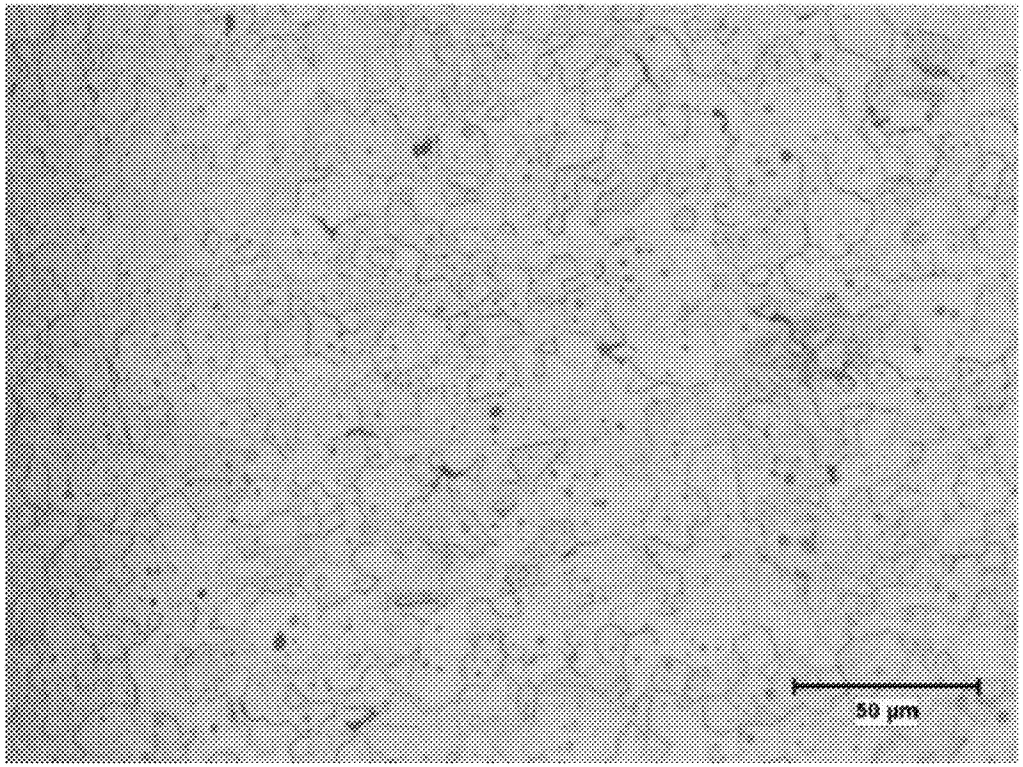
FIG. 8 is a photo of a microstructure of the exemplary electrode material after sintering but before extrusion, where the exemplary electrode material composition shown here is Ru-5Rh-1Re-1Ir.

Sintering step 230 may be performed according to a number of different metallurgical embodiments. For instance, the powder mixture may be sintered in a vacuum, in a reduction atmosphere such as in a hydrogen-contained environment, or in some type of protected environment at a sintering temperature of about 0.5-0.8 $T_{melt}$ of the base alloy in order to form the electrode material. The term "base alloy," as its used herein, generally refers to the alloy formed from all of the constituents except rhenium (Re). In the case of the Ru—Rh—Pt—Re alloy example above, the base alloy is the Ru—Rh—Pt and the sintering temperature may be between 1350° C. and 1800° C. It is also possible for sintering step 230 to apply pressure in order to introduce some type of porosity control to the electrode material. The amount of pressure applied may depend on the precise composition of the powder mixture and the desired attributes of the electrode material. Skilled artisans will appreciate that during the sintering process, the mixing and distribution of the different constituents within the material can depend on their mutual diffusion so that a composition gradient is formed from the grain boundary region to within the lattice or matrix. FIG. 8 is a photo of an exemplary microstructure for the electrode material after sintering but before extrusion, where the exemplary electrode material composition shown here is Ru-5Rh-1Re-1Ir. Generally speaking, single-phase solid solution ruthenium (Ru) is present in FIG. 8 with an average grain size of about 10 μm.

Next, the electrode material may be metal formed such as wire formed like extruded, drawn, or swaged, and such as sheet forming such as rolling, or may be otherwise formed into a desired shape, step 240. If a disk, log, or bar is desired, the electrode material may be subjected to sheet forming. If an elongated wire is desired, the electrode material may be warm or hot extruded to form a fine wire of about 0.3 mm to about 1.5 mm, inclusive, which in turn can be cut or cross-sectioned into individual electrode tips or the like. The electrode material is designed to have a higher room temperature ductility, which can be helpful if a lower extrusion temperature is desired. Of course, other metal forming techniques could be used with step 240 to form the electrode material in parts having different shapes. For example, the electrode material could be swaged, forged, cast or otherwise formed into ingots, sheets, bars, rivets, tips, etc.

The extrusion or wire drawing can be an important after-sintering process. This may be particularly true for ruthenium-based alloys that have a hexagonal close packed (hcp) crystal structure and poor ductility. Ruthenium-based alloys with an hcp crystal structure may have mechanical properties (e.g., strength and ductility) that are highly crystal orientation dependent. Because of the extrusion or wire drawing process, the ruthenium-based alloy wire can have a high texture structure, in which the hexagonal crystal axis of the ruthenium (Ru) phase is about 60°-90° in the wire direction. The degree of texture may be highly dependent on the total deformation during the wire drawing process. According to some embodiments, to get sufficient ductility the deformation should achieve at least 50% reduction in cross-sectional area during the wire drawing or swaging process. In one exemplary embodiment, the preferred area reduction is at least 90% after the wire drawing process. The reduction percent of area is defined as $R\ \% = (D_0^2 - D_f^2)/D_0^2$, where $D_0$ is the initial wire diameter before drawing and $D_f$ is the final wire diameter after wire drawing. A typical extrusion or wire drawing process may include hot drawing of the sintered bar at about the sintering temperature. The hot drawing process may take several passes with the wire diameter gradually reducing after each pass. The final wire may then be annealed at about the sintering temperature.

Figure 9:
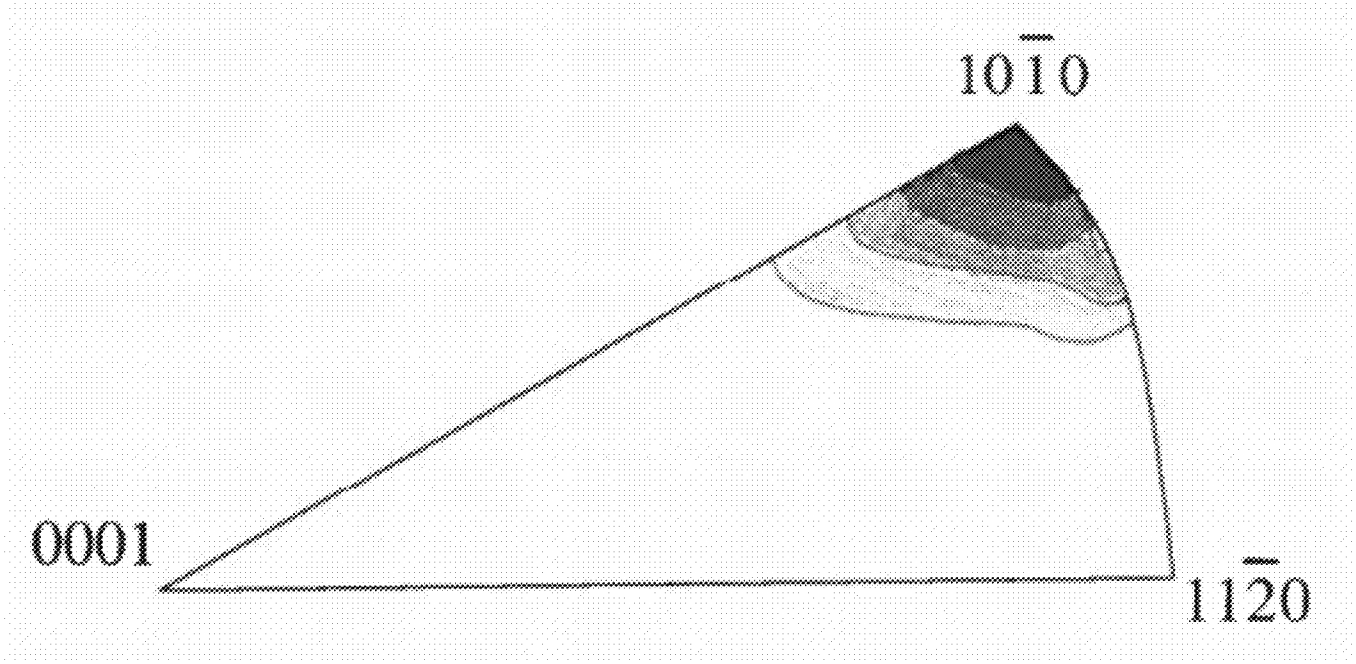
FIG. 9 is a plot showing an extrusion-axis inverse pole figure for the exemplary electrode material after wire drawing, where the exemplary electrode material composition is a powder metallurgy sintered ruthenium-based alloy.

In some instances, the electrode material has a percent elongation that is greater than or equal to about 10% elongation at room temperature, which is defined as the maximum elongation of the gage length divided by the original gage length. This percent elongation may be achieved for the electrode material by using the exemplary steps described above—which include the powder metallurgy sintering with rhenium (Re) addition to clear the grain boundary and wire drawing to form a texture structure. The texture analysis can be obtained, for example, by X-ray diffraction, EBSD analysis. FIG. 9 illustrates an extrusion-axis inverse pole figure of a powder metallurgy sintered ruthenium-alloy after an exemplary wire drawing step, showing that the dominant [10-10] oriented grains are parallel to the extrusion axis after drawing. This plot also indicates that the dominant grains may have turned their [0001] hexagonal axis of crystals to a direction that is perpendicular to the extrusion axis.

In addition, the exemplary extrusion process may help achieve a fiber grain structure for the electrode material. A fiber grain structure for the electrode material may assist in absorbing the crack tip energy and blunting crack tip, and thereby help increase the toughness or overall durability of the electrode material. This may be particularly true in those embodiments where the electrode material is a ruthenium-based alloy.

To achieve a specific texture structure, a hot wire drawing process may be used. The final post-drawn product, for example a 0.7 mm diameter wire made from the present electrode material, can be chopped or sliced into pieces which can then be directly used as firing tip components mounted to a center electrode, ground electrode, intermediate component, etc. In one example, the sliced pieces are used as firing tip component 32 and are attached to intermediate component 34. The final electrode material may have a specific texture, in which the dominant grains have their [0001] hexagonal axis of crystals perpendicular to the elongation axis of the electrode. Of course, other processes such as rolling may be used to achieve a specific texture. After an exemplary hot rolling process, the [0001] axis of grains may be perpendicular to the rolling surface or sheet surface. Spark plug electrode components can be made by cutting a sheet in a correct direction so that the dominant grains having their [0001] hexagonal axis of crystals perpendicular to the elongation axis of electrode.

After the exemplary the sintering and extrusion processes, the electrode materials may have a percent elongation that is greater than or equal to about 10% elongation at room temperature. By providing an iridium- or ruthenium-based material having such attributes, the material is able to enjoy the erosion and/or corrosion resistance of iridium (Ir) or ruthenium (Ru), yet be somewhat ductile and thus workable so that the electrode material can be more easily turned into a useful part. This, in turn, may make the overall manufacturing process less expensive and less complex. Other benefits and/or attributes of the ductile electrode material may present themselves as well.

As mentioned above, it is also possible for method 200 to include an optional step where the electrode material is formed with a cladding or sheath made of a different material, so that the combined electrode material and cladding can be co-extruded during step 240. In one embodiment, an additional step 232 is provided where the already sintered electrode material from step 230 is inserted or stuffed into a tube-like cladding structure. The cladding structure may be precious metal-based, nickel-based, copper-based, or zinc-based, for example. In the event that cladding structure is precious metal-based, the cladding or sheathing may include pure platinum (Pt), pure palladium (Pd), pure gold (Au), pure silver (Ag) or some alloy thereof. In the example of a copper-based cladding structure, oxygen-free copper (Cu) is an acceptable choice. Zinc-based cladding structures may be used in instances where it is desirable to have a high degree of lubrication during the extrusion process. Other cladding materials are also possible. A cladding structure having an outer diameter of about 0.2 mm-2.0 mm and a cladding wall thickness of less than about 150 μm may be used.

In the exemplary copper-based and zinc-based cladding examples introduced above, once the electrode and cladding materials have been co-extruded, the cladding structure may be removed by chemical etching or some other suitable technique, optional step 242. In these examples, the cladding structure is used to facilitate the extrusion process but is removed thereafter so that the resulting electrode material can be formed into a spark plug electrode without any cladding.

Figure 10:
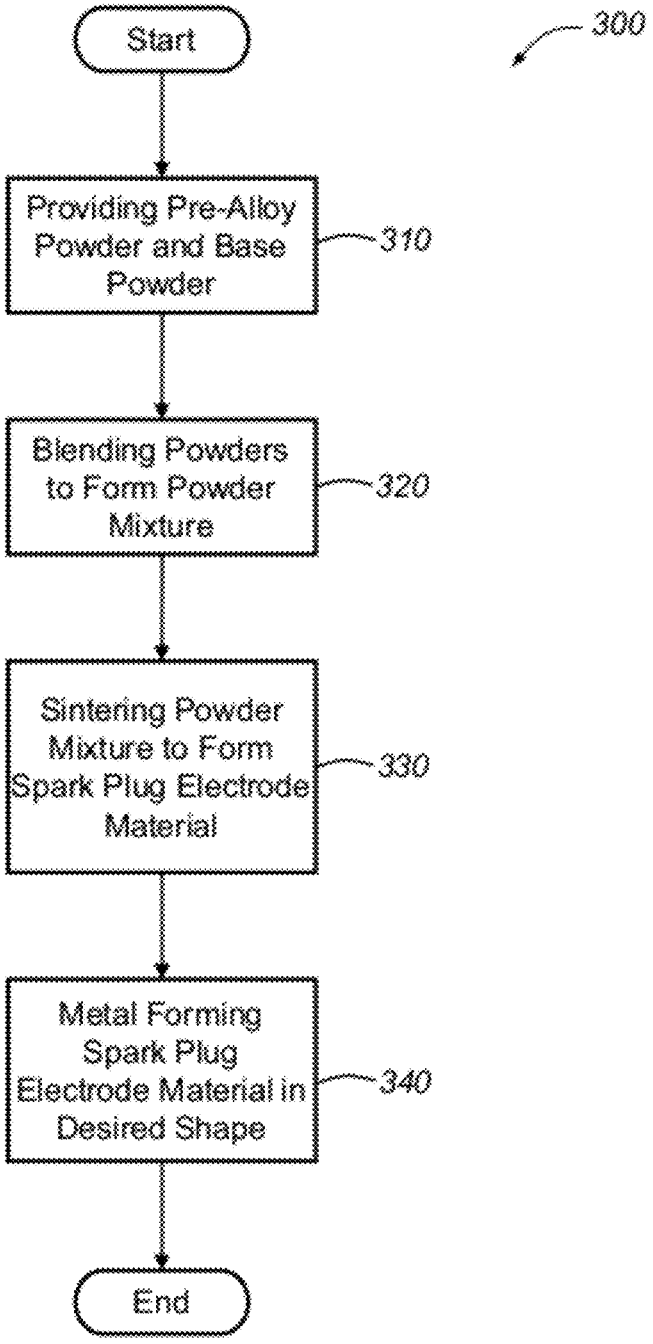
FIG. 10 is a flowchart illustrating an exemplary embodiment of a method for forming a spark plug made from the electrode material described below.
Figure 11:
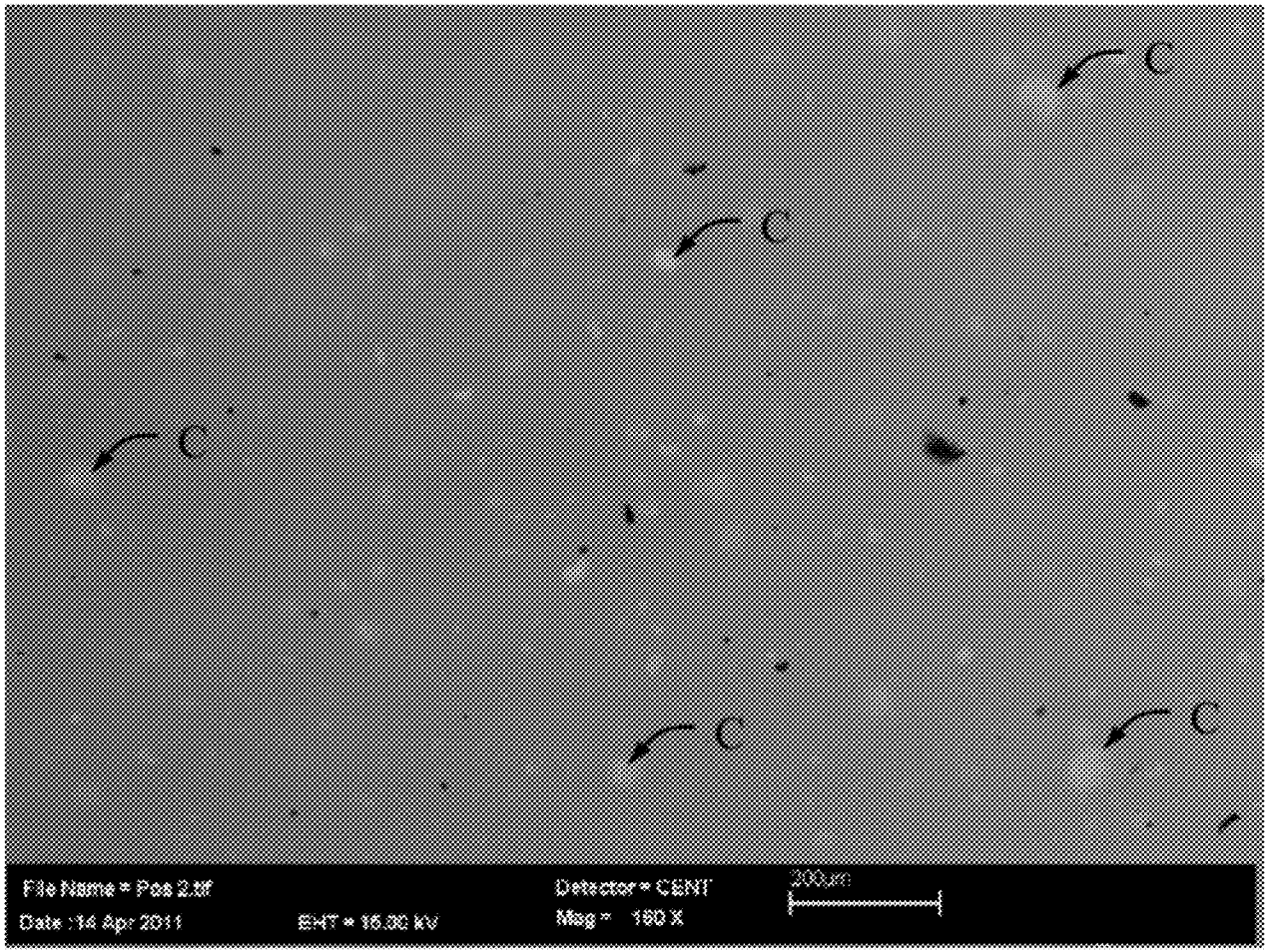
FIG. 11 is a backscatting electron image (BSE) of a microstructure of an exemplary electrode material of Ru-5Rh-1Re, the photo being taken after sintering but before extrusion.

Turning now to FIG. 10, the electrode material can be made using an alternative embodiment to the powder metallurgy method depicted in, and described with reference to, FIG. 7; of course, other methods apart from those of FIGS. 7 and 10 are possible for making the electrode material. Though the method of FIG. 7 is suitable in some embodiments, it has been found that in some cases blending pure particle powders of the single chemical element rhenium (Re) with other pure particle powders of single chemical elements of iridium (Ir) or ruthenium (Ru) can make sintering challenging and can have drawbacks. In one example, blended pure particle powders of rhenium (Re) with pure particle powders of ruthenium (Ru) can leave undissolved rhenium (Re) particles—or rhenium (Re) clusters—adjacent and along grain boundary regions after sintering. Without wishing to be limited to one theory of causation, it is currently believed that insufficient sintering may be one factor contributing to the formation of rhenium (Re) clusters. FIG. 11 depicts a backscatting electron image of a microstructure of an example electrode material composed of Ru-5Rh-1Re-1Ir made with blended pure particle powders of rhenium (Re), and showing undissolved rhenium (Re) clusters C as the brighter spots and brighter portions in the photo. The undissolved rhenium (Re) clusters C can give the electrode material certain undesirable attributes such as decreased ductility and decreased workability. And in the finally-formed spark plug electrode, the undissolved rhenium (Re) clusters C can lead to cracking.

In some embodiments of the electrode material, using the powder metallurgy method of FIG. 10 can limit or altogether eliminate the formation of the undissolved rhenium (Re) clusters C in the electrode material, and therefore can limit or altogether eliminate the associated drawbacks described immediately above. The powder metallurgy method can also facilitate the performance of the sintering step by, for example, decreasing the required sintering temperature and decreasing the required sintering duration. In addition, the powder metallurgy method of FIG. 10 can encourage and can accelerate the dispersion and diffusion of rhenium (Re) into the electrode material lattice or matrix while still maintaining the highest concentration of rhenium (Re) at the grain boundary regions. And the method can facilitate the development of rhenium-rich grain boundaries with the associated desirable attributes described above.

The alternative embodiment, or process 300, of FIG. 10 can have some of the same steps as those described for the method of FIG. 7. One difference is that rhenium (Re) is provided in a pre-alloy powder, step 310. The pre-alloy powder can include a pre-determined amount of rhenium (Re), and a pre-determined amount of iridium (Ir) or ruthenium (Ru). For a particular exemplary electrode material described above, the pre-determined amounts of rhenium (Re) and iridium (Ir) or ruthenium (Ru) are provided in the pre-alloy powder without altering the overall weight percentages of the respective elements in the electrode material. For example, the pre-alloy powder can include approximately 50 wt % of rhenium (Re) and approximately 50 wt % of ruthenium (Ru), while still maintaining the overall weight percentages of rhenium (Re) and ruthenium (Ru) in the particular exemplary electrode material Ru-5Rh-1Re-1Ir. In other examples, the pre-alloy powder can include approximately 30 wt % to 50 wt % of rhenium (Re), and can include approximately 50 wt % to 70 wt % of ruthenium (Ru) or iridium (Ir); of course, other percentages of the elements are possible for the pre-alloy powder.

The pre-alloy powder itself can be formed by way of a number of processes and operations that will be generally known to those skilled in the art, including first combining the elements together and then subjecting them to a powder-production technique such as a metal atomization process or a grinding process. In one example, rhenium (Re) and ruthenium (Ru) are combined by melting them together such as by arc melting or induction melting to form a molten pre-alloy. The molten pre-alloy can then be processed into powder form via metal atomization in which the molten material is fed through an orifice at suitable pressures, and a gas is introduced into the resulting molten stream as it passes through the orifice. The gas generates turbulence in the molten stream as the entrained or trapped gas expands in size due to heating, and the molten stream is then eventually broken into droplets which are turned into powders. This is merely one example of a metal atomization process, other processes, techniques, and steps may be performed in addition to or in lieu of those described above such as nozzle vibration and water introduction. The exact metal atomization process may depend on, among other factors, the desired particle powder size. And of course, other combining and powder-production techniques are possible.

Step 310 also includes providing a base powder of the same iridium (Ir) or ruthenium (Ru) as that included in the pre-alloy powder. For example, if the pre-alloy powder includes a pre-determined amount of rhenium (Re) and a pre-determined amount of iridium (Ir), then the base powder will be pure particle powders of iridium (Ir); and if the pre-alloy powder includes a pre-determined amount of rhenium (Re) and a pre-determined amount of ruthenium (Ru), then the base powder will be pure particle powders of ruthenium (Ru). Step 310 can further include providing one or more pure particle precious metal powders selected from rhodium (Rh), platinum (Pt), palladium (Pd), or gold (Au). Optionally, the base powder itself can be a second pre-alloy powder; for example, the base powder can be a pre-alloy with predetermined amounts of ruthenium (Ru), rhodium (Rh), iridium (Ir), and a combination thereof. The remaining steps of process 300—namely, steps 320, 330, and 340—can be the same as the previously-described steps 220, 230, and 240 for the method of FIG. 7. Furthermore, the process 300 may include the one or more optional steps of providing a cladding or sheath, as previously-described.

Figure 12:
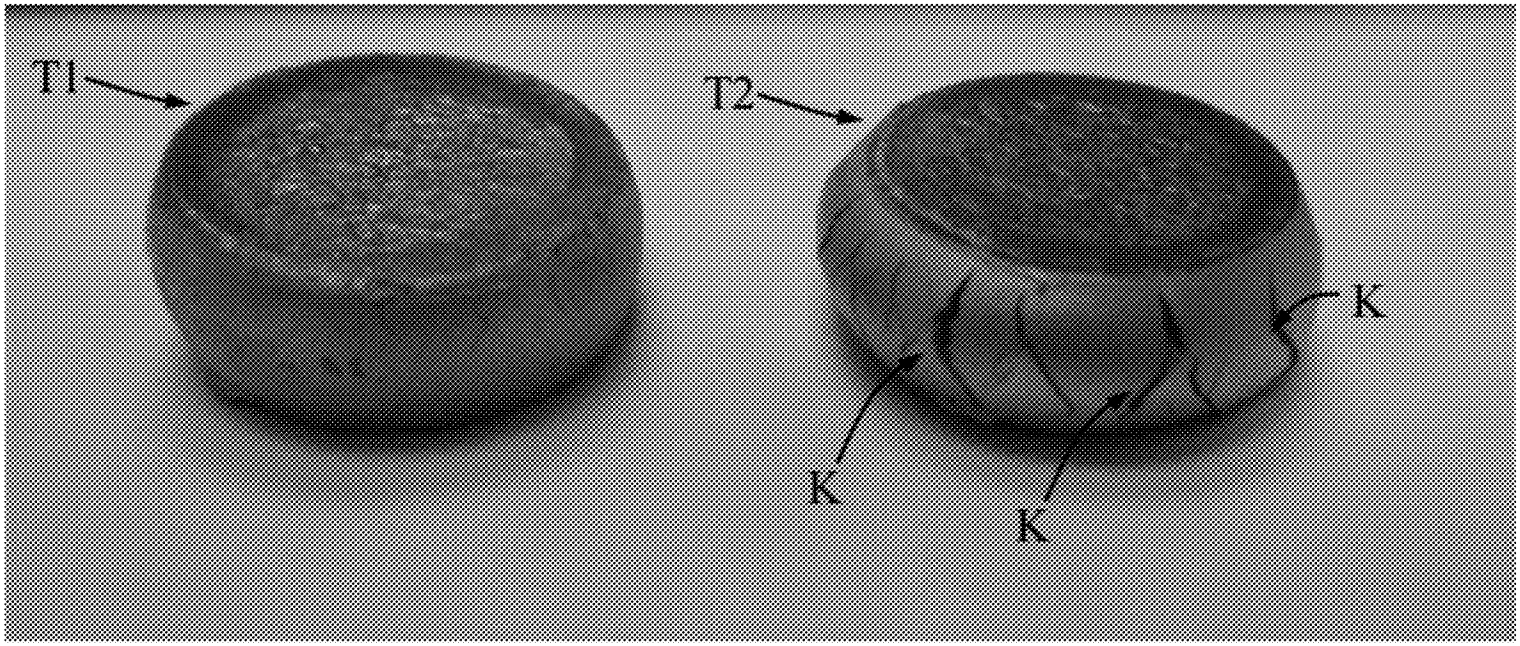
FIG. 12 is a photo of two test samples shown after being subjected to a Gleeble experiment, both samples being made of an electrode material of Ru-5Rh-1Re-1Ir, and one of the samples being made from the forming method of FIG. 10.

Turning now to FIG. 12, what is commonly known as a Gleeble experiment was performed on a first and second test sample $T_1$ and $T_2$ that were composed of an electrode material of Ru-5Rh-1Re-1Ir. In this experiment, the first test sample $T_1$ was made using the powder metallurgy method described with reference to FIG. 10, and was therefore provided rhenium (Re) and ruthenium (Ru) as a pre-alloy powder with approximately 50 wt % of rhenium (Re) and approximately 50 wt % of ruthenium (Ru). While the second test sample $T_2$ was made using a powder metallurgy method of blended pure particle powders of rhenium (Re) and pure particle powders of ruthenium (Ru). Before experimentation, the first and second test samples $T_1$ and $T_2$ had a cylindrical shape measuring 10 mm in height and 10 mm in diameter. As skilled artisans will know, in a typical Gleeble experiment, test samples are heated by direct resistance and are subjected to mechanical loads while various parameters are measured, controlled, and recorded for analysis. Here, the first and second test samples $T_1$ and $T_2$ were heated to an experimental temperature of approximately 1,400° C. and then were mechanically compressed to approximately 50% deformation. With reference to FIG. 12, after testing, the first test sample $T_1$ exhibited less visible cracking K than the second test sample $T_2$. It should be appreciated that not all Gleeble experiments need be performed with the above parameters, and not all Gleeble experiments will necessarily yield the same results as shown in FIG. 12.

The above-described processes may be used to form the electrode material into various shapes (such as rods, wires, sheets, etc.) that are suitable for further spark plug electrode and/or firing tip manufacturing processes. Other known techniques such as melting and blending the desired amounts of each constituent may be used in addition to or in lieu of those steps mentioned above. The electrode material can be further processed using conventional cutting and grinding techniques that are sometimes difficult to use with other known erosion-resistant electrode materials.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A spark plug, comprising:

a metallic shell having an axial bore;

an insulator being at least partially disposed within the axial bore of the metallic shell, the insulator having an axial bore;

a center electrode being at least partially disposed within the axial bore of the insulator; and a ground electrode being attached to the metallic shell;

the center electrode, the ground electrode, or both the center and ground electrodes includes an electrode material having ruthenium (Ru), rhenium (Re), and at least one precious metal selected from the group consisting of: iridium (Ir), rhodium (Rh), platinum (Pt), palladium (Pd), or gold (Au);

wherein the ruthenium (Ru) is the single largest constituent of the electrode material on a weight percentage (wt %) basis, the rhenium (Re) is present in the electrode material in an amount from about 0.1 wt % to 5 wt %, and the at least one precious metal has a smaller weight percentage than the ruthenium (Ru), and the rhenium (Re) has a smaller weight percentage than the at least one precious metal.

2. The spark plug of claim 1, wherein the electrode material includes ruthenium (Ru) from about 50 wt % to 99.9 wt %, inclusive, rhodium (Rh) from about 0.1 wt % to 49.9 wt %, inclusive, rhenium (Re) from about 0.1 wt % to 5 wt %, inclusive, and iridium (Ir) from about 0.1 wt % to 5 wt %, inclusive.

3. The spark plug of claim 2, wherein the rhodium (Rh) is provided in an amount of about 5 wt % the rhenium (Re) is provided in an amount of about 1 wt %, and the iridium is provided in an amount of about 1 wt %.

4. A spark plug, comprising:

a metallic shell having an axial bore;

an insulator being at least partially disposed within the axial bore of the metallic shell, the insulator having an axial bore;

a center electrode being at least partially disposed within the axial bore of the insulator; and a ground electrode being attached to the metallic shell;

the center electrode, the ground electrode, or both the center and ground electrodes includes an electrode material having ruthenium (Ru) and rhenium (Re), wherein the ruthenium (Ru) is the single largest constituent of the electrode material on a weight percentage (wt %) basis and the rhenium (Re) is present in the electrode material in an amount from about 0.1 wt % to 5 wt %;

the center electrode, the ground electrode, or both the center and ground electrodes includes an attached firing tip that is at least partially made from the electrode material, wherein the firing tip is a multi-piece rivet that includes a second component attached to the center electrode or the ground electrode, and a first component that is attached to the second component and is at least partially made from the electrode material.

5. A spark plug, comprising:

a metallic shell having an axial bore;

an insulator being at least partially disposed within the axial bore of the metallic shell, the insulator having an axial bore;

a center electrode being at least partially disposed within the axial bore of the insulator; and a ground electrode being attached to the metallic shell;

the center electrode, the ground electrode, or both the center and ground electrodes includes an electrode material having ruthenium (Ru) and rhenium (Re), wherein the ruthenium (Ru) is the single largest constituent of the electrode material on a weight percentage (wt %) basis and the electrode material has a percent elongation that is greater than or equal to about 10% elongation at room temperature.

6. A spark plug, comprising:

a metallic shell having an axial bore;

an insulator being at least partially disposed within the axial bore of the metallic shell, the insulator having an axial bore;

a center electrode being at least partially disposed within the axial bore of the insulator; and a ground electrode being attached to the metallic shell;

the center electrode, the ground electrode, or both the center and ground electrodes includes an electrode material having ruthenium (Ru) and rhenium (Re), wherein the ruthenium (Ru) is the single largest constituent of the electrode material on a weight percentage (wt %) basis and the electrode material has a plurality of grains with at least some of the grains being separated by a rhenium-rich grain boundary region.

7. The spark plug of claim 6, wherein the electrode material is provided with a specific texture structure where dominant (1 0 1 0) oriented grains are parallel to an elongation axis of the extrusion.

8. A spark plug, comprising:

a metallic shell having an axial bore;

an insulator being at least partially disposed within the axial bore of the metallic shell, the insulator having an axial bore;

a center electrode being at least partially disposed within the axial bore of the insulator; and a ground electrode being attached to the metallic shell;

the center electrode, the ground electrode, or both the center and ground electrodes includes an electrode material having at least one of iridium (Ir) or ruthenium (Ru) and having rhenium (Re), wherein the at least one of iridium (Ir) or ruthenium (Ru) is the single largest constituent of the electrode material on a weight percentage (wt %) basis, and wherein the electrode material has a plurality of grains with at least some of the grains being separated by a rhenium-rich grain boundary region.

9. The spark plug of claim 8, wherein the rhenium-rich grain boundary region has a higher concentration of rhenium (Re) than is found inside of the electrode material lattice or matrix.

10. The spark plug of claim 8, wherein the rhenium-rich grain boundary region has an average grain boundary region length (L) from about 1 μm to 20 μm, and has an average grain boundary region width (W) from about 0.01 μm to 5 μm.

11. A method of preparing a spark plug electrode material, comprising the steps of:

(a) providing a pre-alloy powder that includes a pre-determined amount of iridium (Ir) or ruthenium (Ru), and that includes a pre-determined amount of rhenium (Re);

(b) providing a base powder of the same iridium (Ir) or ruthenium (Ru) that is present in the pre-alloy powder;

(c) blending the pre-alloy powder and base powder together to form a powder mixture; and (d) sintering the powder mixture to form the spark plug electrode material.

12. The method of claim 11, wherein the pre-determined amount of iridium (Ir) or ruthenium (Ru) is between about 50 wt % to 70 wt %, inclusive, of the pre-alloy powder, and the pre-determined amount of rhenium (Re) is between about 30 wt % to 50 wt %, inclusive, of the pre-alloy powder.

13. The method of claim 12, wherein the pre-determined amount of iridium (Ir) or ruthenium (Ru) is about 50 wt % of the pre-alloy powder, and the pre-determined amount of rhenium (Re) is about 50 wt % of the pre-alloy powder.

14. The method of claim 11, wherein step (a) further comprises forming the pre-alloy powder via a metal atomization process.

15. The method of claim 11, wherein step (b) further comprises providing at least one precious metal powder selected from the group consisting of: rhodium (Rh), platinum (Pt), palladium (Pd), or gold (Au).

16. The method of claim 11, further comprising the step of:

(e) drawing the spark plug electrode material to form a spark plug electrode wire.

17. The method of claim 11, further comprising the step of:

(e) deep hot extruding the spark plug electrode material wherein the material is provided with a specific texture structure where dominant (1 0 −1 0) oriented grains are parallel to an elongation axis of the extrusion.

* * * * *

UNITED STATES PATENT AND TRADEMARK OFFICE

CERTIFICATE OF CORRECTION

PATENT NO. : 8,760,044 B2
APPLICATION NO. : 13/402437
DATED : June 24, 2014
INVENTOR(S) : Shuwei Ma It is certified that error appears in the above-identified patent and that said Letters Patent is hereby corrected as shown below:

In the Claims

Column 15, claim 7, line 26, delete "(10 10)" and insert --(10-10)--

Signed and Sealed this
Twenty-third Day of September, 2014

Michelle K. Lee

Michelle K. Lee
*Deputy Director of the United States Patent and Trademark Office*